US012084943B2

(12) United States Patent
Harestad

(10) Patent No.: US 12,084,943 B2
(45) **Date of Patent: *Sep. 10, 2024**

(54) VALVE DEVICE AND METHOD

(71) Applicant: PETROLEUM TECHNOLOGY COMPANY AS, Stavanger (NO)

(72) Inventor: Kristian Harestad, Stavanger (NO)

(73) Assignee: Petroleum Technology Company AS, Stavanger (NO)

( * ) Notice: Subject to any disclaimer, the term of this patent is extended or adjusted under 35 U.S.C. 154(b) by 82 days.

This patent is subject to a terminal disclaimer.

(21) Appl. No.: 17/952,486

(22) Filed: Sep. 26, 2022

(65) Prior Publication Data

US 2023/0016342 A1 Jan. 19, 2023

Related U.S. Application Data

(63) Continuation of application No. 16/464,092, filed as application No. PCT/NO2017/050313 on Dec. 4, 2017, now Pat. No. 11,454,086.

(30) Foreign Application Priority Data

Dec. 5, 2016 (NO) ..... 20161936

(51) Int. Cl.
*E21B 34/02* (2006.01)
*E21B 23/00* (2006.01)
(Continued)

(52) U.S. Cl.
CPC ..... *E21B 34/02* (2013.01); *E21B 23/00* (2013.01); *E21B 33/00* (2013.01); *E21B 33/02* (2013.01);
(Continued)

(58) Field of Classification Search
CPC ..... E21B 34/02
See application file for complete search history.

(56) References Cited

U.S. PATENT DOCUMENTS 2,250,244 A 7/1941 Yancey
4,184,504 A 1/1980 Carmichael et al.
(Continued)

FOREIGN PATENT DOCUMENTS

GB 2351103 A 12/2002
WO 2009102214 A1 8/2009
(Continued)

OTHER PUBLICATIONS

PCT International Search Report; PCT/NO2017/050313; Date of Mailing Aug. 8, 2018.
(Continued)

*Primary Examiner* — Jonathan Malikasim
(74) *Attorney, Agent, or Firm* — K&L Gates LLP

(57) ABSTRACT

A valve device having a valve with first connection elements for mounting the valve in a port of a wellhead, a spool unit having a through-channel, second connection elements arranged in the through-channel, and a flange, the flange configured for sealingly mounting the spool unit to the wellhead, aligning the through-channel with the port, and a plug comprising third connection elements configured for sealingly and removably engaging the second connection elements and attach the plug in the through-channel. A method for removing, replacing or arranging a valve located in a port of a wellhead is also provided.

20 Claims, 10 Drawing Sheets

(51) Int. Cl.

| | |
|---|---|
| ***E21B 33/00*** | (2006.01) |
| ***E21B 33/02*** | (2006.01) |
| ***E21B 33/03*** | (2006.01) |
| ***E21B 33/04*** | (2006.01) |
| ***E21B 33/068*** | (2006.01) |
| ***E21B 34/00*** | (2006.01) |
| ***E21B 34/16*** | (2006.01) |

(52) U.S. Cl.
CPC ..... *E21B 33/03* (2013.01); *E21B 33/04* (2013.01); *E21B 33/068* (2013.01); *E21B 34/00* (2013.01); *E21B 34/16* (2013.01)

(56) References Cited

U.S. PATENT DOCUMENTS

| | | | | |
|---|---|---|---|---|
| 4,460,039 | A * | 7/1984 | Knight | E21B 34/02 166/85.4 |
| 5,103,900 | A | 4/1992 | McLeod et al. | |
| 7,069,987 | B2 | 7/2006 | Kwasniewski | |
| 7,578,351 | B2 | 8/2009 | Dallas | |
| 7,857,062 | B2 * | 12/2010 | Dallas | E21B 34/02 166/95.1 |
| 8,181,700 | B2 * | 5/2012 | Baugh | E21B 33/068 166/97.5 |
| 10,352,123 | B2 | 7/2019 | Landry | |
| 10,502,021 | B2 * | 12/2019 | Healy | E21B 47/06 |
| 11,454,086 | B2 * | 9/2022 | Harestad | E21B 34/02 |
| 11,530,592 | B2 * | 12/2022 | Perschke | E21B 19/086 |
| 11,834,925 | B2 * | 12/2023 | Alamer | E21B 1/22 |
| 2008/0087439 | A1 | 4/2008 | Dallas | |
| 2015/0260010 | A1 | 9/2015 | Lugtmeier | |
| 2015/0376977 | A1 | 12/2015 | Nguyen et al. | |
| 2019/0284900 | A1 * | 9/2019 | Harestad | E21B 34/02 |
| 2021/0285302 | A1 * | 9/2021 | Dalinger | E21B 33/072 |

FOREIGN PATENT DOCUMENTS

| | | | |
|---|---|---|---|
| WO | 2011093717 | A2 | 8/2011 |
| WO | 2011098602 | A1 | 8/2011 |
| WO | 2012009451 | A1 | 1/2012 |
| WO | 2015162241 | A1 | 10/2015 |
| WO | 2015168454 | A1 | 11/2015 |

OTHER PUBLICATIONS

Norwegian Search Report; NO 20161936; Date of Report Jun. 19, 2017.

Canadian Office Action corresponding to related Canadian Patent Application No. 3,045,610 dated Nov. 8, 2023, 12 pages.

* cited by examiner

--Prior Art--

VALVE DEVICE AND METHOD

CROSS REFERENCES TO RELATED APPLICATIONS

The present application is a continuation of application Ser. No. 16/464,092 filed on May 24, 2019, the entire content of which is hereby incorporated by reference herein.

BACKGROUND

Field of the Disclosure

The present disclosure relates to a valve device that may be used, for example, to vent fluid from a well annulus or to inject fluid into a well annulus via a wellhead or valve tree port. The present disclosure also relates to a method for arranging, removing or replacing a valve in a port of a wellhead.

Description of the Related Art

In petroleum wells, it is common to have arrangements for injection or venting of fluids from annuli or other pipes in the completion, such as an annulus between the well casing and a tubing string arranged in the casing. This is conventionally carried out through conduits arranged in the wellhead or valve tree (Xmas tree), with valve devices arranged therein to control fluid flow.

From a safety aspect there is a preference and a requirement for a double barrier philosophy in a well design and operations. For example, UK Patent Application GB 2 351 103 A shows an annulus valve assembly for hydrocarbon wells comprising a passage extending through a side wall of a wellhead and first and second valves positioned to open or close the passage. Other documents which can be useful for understanding the background include WO 2015/162241 A1, US 2015/376977 A1, U.S. Pat. No. 4,184,504 A, WO 2009/102214, WO 2011/093717 and WO 2011/098602.

From time to time, such valve devices may become worn or damaged, or need to be replaced for other reasons. There is therefore a need in the industry for valve devices which allow as uncomplicated and safe removal or replacement of such valve devices (or parts thereof) as possible. It is also desirable that such valve devices be compact and lightweight, while at the same time being structurally strong and resistant to damage, for example from debris or impacts from other equipment during operations on the wellhead or valve tree.

The present disclosure has the objective to provide a valve device which provides advantages over known solutions and techniques with regards to the above mentioned or other aspects.

SUMMARY

In an embodiment, there is provided a valve device having a valve comprising first connection elements configured for sealingly and removably mounting of the valve in a port of a wellhead of a hydrocarbon well, a spool unit having a through-channel extending between a first end and a second end of the spool unit, second connection elements arranged in the through-channel, and a flange, the flange configured for sealingly mounting the spool unit to the wellhead, aligning the through-channel with the port, and a plug comprising third connection elements configured for sealingly and removably engaging the second connection elements and attach the plug in the through-channel In an embodiment, the valve device comprises a blind flange removably mounted to the second end such as to cover an end opening of the through-channel.

In an embodiment, the valve comprises a tool engagement element configured for cooperation with a placement and removal tool, and/or the plug comprises a tool engagement element configured for co-operation with a placement and removal tool.

In an embodiment, the flange comprises a first conduit extending through a side wall of the valve device and into the through-channel.

In an embodiment, the through-channel has a first through-channel portion and a second through-channel portion, the first through-channel portion configured to accommodate a part of the valve and the second through-channel portion configured to accommodate the plug.

In an embodiment, the first through-channel portion has a smaller cross section area than the second through-channel portion.

In an embodiment, the cross section area of the second through-channel portion is sufficiently large to allow the valve to pass therethrough.

In an embodiment, the valve device further comprises an annular shoulder arranged between the first through-channel portion and the second through-channel portion.

In an embodiment, the annular shoulder is arranged to co-operate with the plug for providing a metal-to-metal seal between the through-channel and the plug.

In an embodiment, the spool unit comprises a second conduit extending through a side wall of the valve device and into the through-channel and opening into the through-channel between the first through-channel portion and the second through-channel portion.

In an embodiment, the valve device comprises a third conduit extending through a side wall of the valve device and into the through-channel and opening into the through-channel in the first through-channel portion, the third conduit being configured to cooperate with an actuator port of the valve.

In an embodiment, the third conduit is configured to transmit a hydraulic control fluid to the valve.

In an embodiment, the valve is electrically actuated and the third conduit is configured to contain an electric supply line arranged for actuation of the valve.

In an embodiment, there is provided a wellhead for a hydrocarbon well, having a valve device according to any of the above embodiments mounted thereon.

In an embodiment, there is provided a method for removing or replacing a valve located in a port of a wellhead having a valve device according to any one of the preceding claims mounted thereon, the method comprising:

- mounting a valve unit and a placement and removal tool to the second end;
- inserting an arm of the tool into the spool unit, operating the arm to disengage the plug from the spool unit, and withdrawing the arm and the plug out of the spool unit;
- detaching the tool and the plug from the valve unit;
- reattaching the tool to the valve unit;
- inserting the arm into the spool unit, operating the arm to disengage the valve from the port, and withdrawing the arm and the valve out of the spool unit; and detaching the tool and the valve from the valve unit.

In an embodiment, the method comprises:

- positioning the valve or a replacement valve onto the arm, and reattaching the tool to the valve unit;

inserting the arm and the valve or the replacement valve into the spool unit, operating the arm to mount the valve or the replacement valve inside the port, and withdrawing the arm out of the spool unit;

detaching the tool from the valve unit, positioning the plug or a new plug onto the arm, and reattaching the tool to the valve unit;

inserting the arm and the plug or the new plug into the spool unit, operating the arm to mount the plug or the new plug inside the spool unit.

In an embodiment, at least one of the steps of operating the arm to mount the valve or the replacement valve inside the port or operating the arm to mount the plug or the new plug inside the spool unit comprises rotating the arm about a longitudinal axis of the tool.

In an embodiment, at least one of the steps of operating the arm to disengage the plug from the spool unit or operating the arm to disengage the valve from the port comprises rotating the arm about a longitudinal axis of the tool.

In an embodiment, the method comprises removing the blind flange from the second end, and/or reattaching the blind flange to the second end.

In an embodiment, there is provided a method for arranging a valve in a port of a wellhead having a valve device, the method comprising:

mounting a valve unit and a placement and removal tool to the second end; positioning a valve onto an arm of the tool;

inserting the arm and the valve into the spool unit; operating the arm to mount the valve inside the port, and withdrawing the arm out of the spool unit;

detaching the tool from the valve unit;

positioning a plug onto the arm, and reattaching the tool to the valve unit;

inserting the arm and the plug into the spool unit; and operating the arm to mount the plug inside the spool unit.

In an embodiment, the valve comprises first and second sections connected to each other by threaded parts, wherein the method comprises the step of: inserting the arm into the spool unit, operating the arm to disengage the first section from the second section, and withdrawing the arm and the first section out of the spool unit.

In an embodiment, the valve comprises first and second sections connected to each other by threaded parts, wherein the method comprises the step of: inserting the arm into the spool unit, operating the arm to mount the first section onto the second section, and withdrawing the arm out of the spool unit.

In an embodiment, the valve is a dummy valve.

BRIEF DESCRIPTION OF THE DRAWINGS

Illustrative embodiments will now be described with reference to the appended drawings, in which.

DETAILED DESCRIPTION

Figure 1:
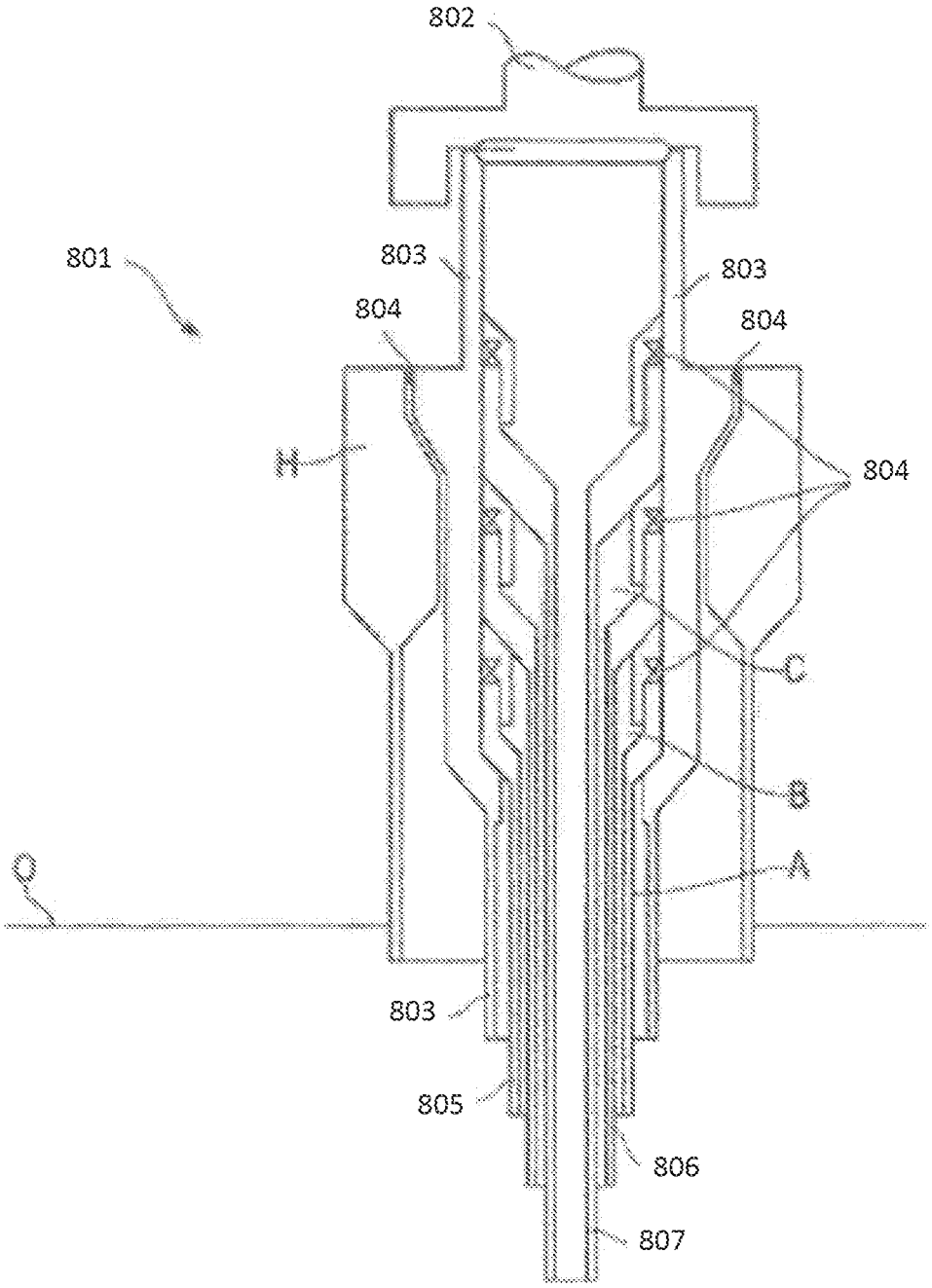
FIG. 1 illustrates a wellhead structure of a petroleum well.

FIG. 1 schematically illustrates a typical wellhead structure that is used in connection with a hydrocarbon well. The wellhead structure has a wellhead 801 which is positioned on a base formation O. The wellhead 801 comprises a housing H and a first casing 803, a second casing 805, a third casing 806 and a fourth 807 casing which extend coaxially a distance down into the base formation O such that a first annular space A, or annulus, is formed between the first casing 803 and the second casing 805, a second annulus B is formed between the second casing 805 and the third casing, and a third annulus is formed C between the third casing 806 and the fourth casing 807. Sealing devices 804, in the form of packers, are arranged between the housing H and the casings 803, 805, 806, 807 such that pressure tight connections between the housing H and the casings 803, 805, 806, 807 are obtained. When the hydrocarbon well is in production, a production tubing (not shown) will be arranged inside the fourth casing 807.

Ports or channels are arranged in the wellhead 801 to allow access from outside the wellhead 801 to one or more of the annuli A, B, C, for injection of fluids into an annulus or a production pipe, for example for gas lift or chemical injection purposes, or in order to bleed off fluids, for example in the case of a pressure build-up in the annulus. Valves will typically be installed in the ports or channels in the wellhead structure for this purpose. Such valves may be arranged to be actively be opened by applying hydraulic pressure or actively closed by a pre-tensioned elastic element, such as a spring, when no hydraulic force is present. In the closed position the valve will act as a fail safe closed barrier, even if e.g. hydraulic supply lines should be damaged.

Figure 2:
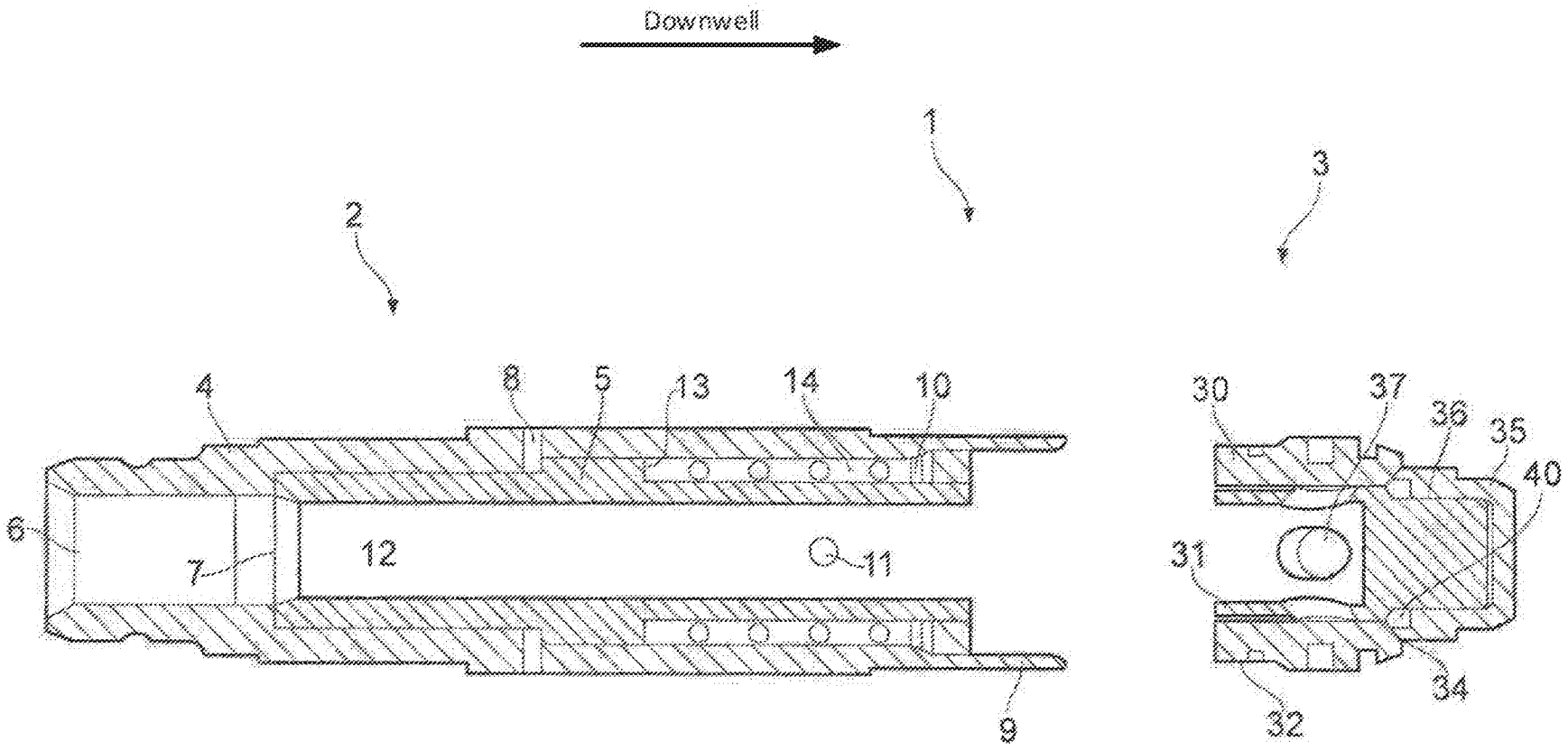
FIG. 2 illustrates a valve.

FIG. 2 shows an example of a valve 200 suitable for this purpose. The valve 200 has two separable sections 2, 3. When the valve 200 is installed, the two sections 2, 3 are connected to each other through a connection, but they will break loose if a first section 2 is exposed to an external force. For clarity, the two sections 2, 3 are shown in an unconnected state in FIG. 2.

The first section 2, which is arranged within spool unit 102 (see FIG. 3) mounted to a Christmas tree or a wellhead 300, comprises an outer hollow housing 4 and an internal body 5. Further, the internal body 5 is arranged movable within the longitudinal direction of the outer housing 4. The internal body is furthermore designed to be hollow, thereby providing a bore 12 through the internal body 5. In order to supply fluid through the valve 200, the outer housing 4 has an inlet 6. In relation to the inlet 6 there may also be arranged an orifice 7 in a distance from the inlet 6, where the orifice 7 is configured to regulate the flow through the valve 200, for instance to create a rotating flow pattern, in order to give the flow of fluid through the valve valve 200 an advantageous flow pattern with minimal pressure loss. An opening 8 in the outer housing 4 is arranged to operate the valve 200 between a closed and an open position by means of externally provided hydraulic fluid. Appropriate sealing elements are arranged between the internal body 5 and the outer housing 4 for this purpose.

The first section 2 further comprises an opening 11, connecting the internal bore 12 with an chamber 14 formed between the outer housing and the internal body and the stop surface 10 of the outer housing and a stop surface 13 formed in the outer wall of the internal body 5, limiting the movement of the internal body 5 relative the outer housing in the open state of the valve. In this chamber 14 an elastic element, such as a spring, may be arranged, where the elastic element will secure that the internal movable body 5 is pushed back in its initial position when no hydraulic pressure is applied to the valve 200.

On an opposite end of the inlet 6, the outer hollow housing 4 of the first section 2 comprises a threaded part 9, which threaded part 9 can be connected to a threaded part 32 on a second section 3 of the valve 200.

The second section 3 of the valve 200 comprises an outer hollow housing 30 and an internal movable body 31 arranged within the outer housing 30. The internal movable body 31 is arranged with an internal bore. One end of the outer hollow housing 30 is arranged with a threaded part 32, which threaded part will co work with the threaded part 9 in the first section 2. An opposite end of the outer hollow housing 30 will form one part of a sealing surface 34, while the internal movable body 31 connected to an end part 35 will form the other part of the sealing surface 34. The internal movable body 31 is connected to the end part 35 through a threaded connection 36. The outer hollow housing 30 and the internal movable body 31 with the end part 35 will in this way form a metal-to-metal seal. As the internal movable body 31 together with the end part 35 will be lifted off the sealing surface 34 when the valve 200 is opened, the sealing surface 34 will also function as a valve seat. Between the two sealing surfaces a sealing element 40 may be positioned. As for the first section 2, an elastic element, such as a spring, may be arranged in the second section 3 between the outer hollow housing 30 and the internal movable body 31 such as to urge the internal movable body 31 towards a closed position. Alternatively, no elastic element is used and the internal movable body 31 is held in the closed position by the external pressure acting on the end part 35. Openings 37 through the internal movable body 31 provides fluid communication between the bore 12 and the openings between the end part 35 and the outer hollow housing 30 when in the open position.

The threaded connection 9, 32 between the first and second section 2, 3 is a weakened connection such that it will break off or bend if the flange, in which the first section 2 of the valve 200 is arranged, is subjected to an unforeseen external force (a blow or strike) this force leading to that the flange in knocked off or get out of the position.

Alternatively, the valve 200 may be made up of one piece, i.e. without the threaded connection 9, 32, but otherwise with the same functionality as described above.

Figure 3:
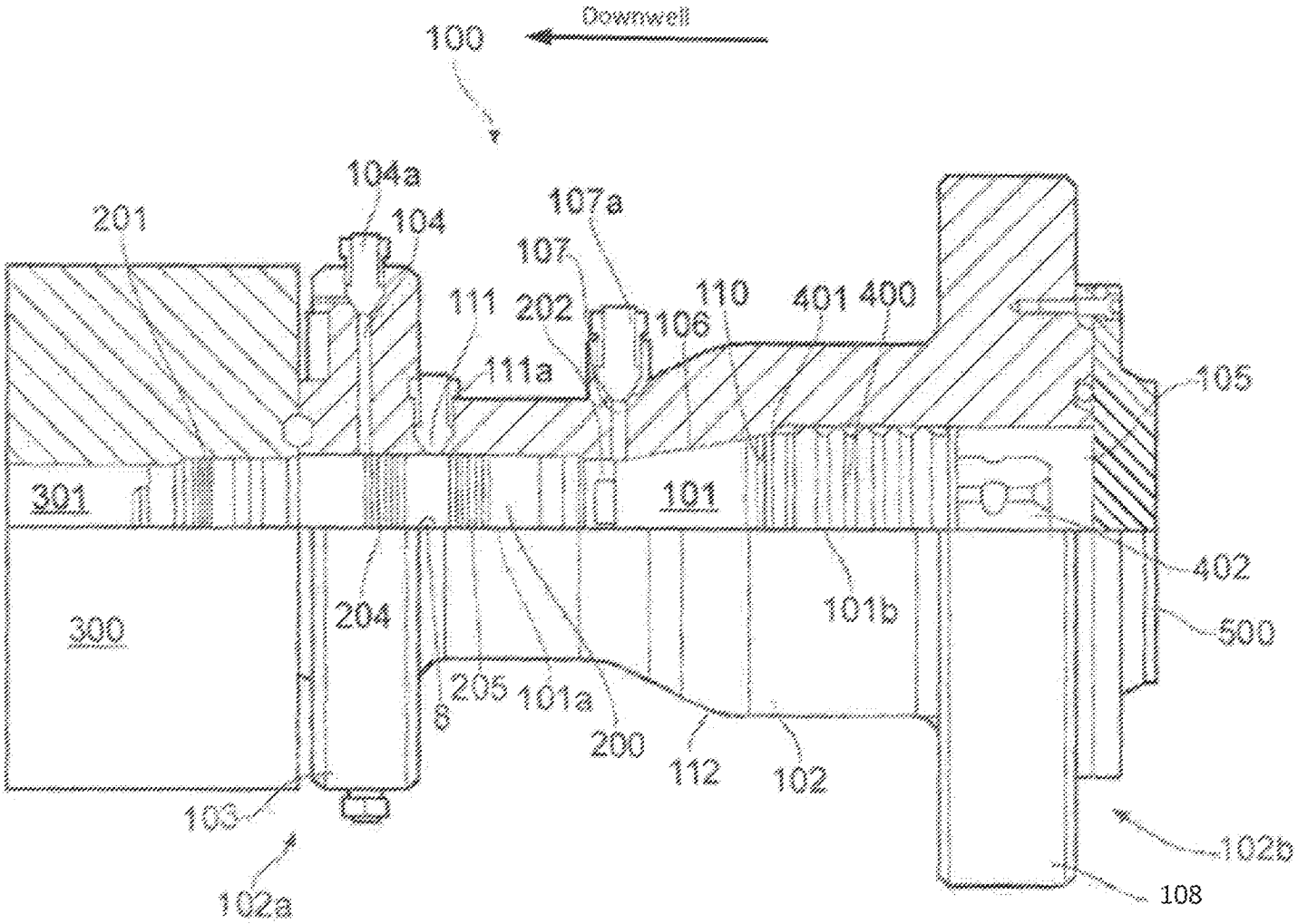
FIG. 3 illustrates a valve device according to an embodiment.

In an embodiment, illustrated in FIG. 3, there is provided a valve device 100. The valve device 100 comprises a valve 200 having first connection elements 201, in this embodiment threads, configured for sealingly and removably mounting of the valve 200 in a port 301 of a wellhead 300 of a hydrocarbon well. The port 301 may be fluidly connected with and lead to an annulus of a well completion, such as in the example shown in FIG. 1 and described above, or lead to a production pipe of the well, an injection pipe, or similar. The valve 200 thereby seals the port 301 and prevent fluid flow through the port 301.

The device 100 has a spool unit 102 with a through-channel 101 extending between a first end 102 a and a second end 102*b*, and a flange 103 arranged in conjunction with the first end 102*a*. The first flange 103 is configured for sealingly mounting the spool unit 102 to the wellhead 300, aligning the through-channel 101 with the port 301. A second flange 108 is arranged in conjunction with the second end 102*b*.

The valve 200 extends out of the port 301 and into the through-channel 101 of the spool unit 102, where it is accommodated in a first through-channel portion 101*a* of the through-channel 101 which is configured to receive and hold a part of the valve 200. At its rear end, the valve 200 has a tool engagement element 202 for co-operation with a placement and removal tool 758, described in further detail below.

Second connection elements 110, in this embodiment threads, are arranged in the through-channel 101. A plug 400 comprising third connection elements 401, in this embodiment threads, is configured for sealingly and removably engaging the second connection elements 110 such as to mount the plug 400 in the through-channel 101. The plug 400 is arranged in a second through-channel portion 101*b* which is configured to accommodate the plug 400. The plug 400 thereby blocks the through-channel 101 and prevents fluid flow therethrough. By means of the valve 200 and the plug 400, a double barrier between the hydrocarbon well and the outside of the valve device 100 is obtained. The plug 400 has a tool engagement element 402 for co-operation with a placement and removal tool 758, described in further detail below.

An annular shoulder 106 is arranged between the first through-channel portion 101*a* and the second through-channel portion 101*b*. The annular shoulder 106 may be arranged to co-operate with the plug 400 for providing a metal-to-metal seal between the through-channel 101 and the plug 400.

The second through-channel portion 101*b* has a larger cross-sectional area, i.e. a larger bore, than the first through-channel portion 101*a*, such as to allow the valve 200 to pass through the second through-channel portion 101*b* and out of an end opening 105 of the through-channel 101.

A blind flange 500, such as a dust cap, is removably mounted to the second end 102*b* such as to cover the end opening 105 of the through-channel 101. This protects the through-channel 101 and the tool engagement element 402 of the plug 400 from e.g. dust, debris, or contaminations from the surroundings.

The flange 103 has a first conduit 104 extending from an outer side wall 112 of the valve device 100 and into the through-channel 101. The first conduit 104 can be used as a test port, to pressure test the seals when the valve 200 and the plug 400 are installed. A connector 104*a* is arranged on the outer side wall 112 in conjunction with the first conduit 104 to allow e.g. a pressure test pipe to be connected.

The spool unit 102 further has a second conduit 107 extending from an outside wall 112 of the valve device 100 into the through-channel 101 and opening into the through-channel 101 between the first through-channel portion 101*a* and the second through-channel portion 101*b*. The second conduit 107 can be used as a test or bleed-off port to pressure test the seals e.g. when the valve 200 and the plug 400 are installed, or for bleed-off, i.e. to remove any built-up pressure in the through-channel 101. Alternatively, or in addition, the second conduit 107 can be used for injection, e.g. injection of chemicals or gas into the well (for example for gas lift operations) via the valve 200 and the port 301. A connector 107*a* is arranged on the outer side wall 112 in conjunction with the second conduit 107 to allow e.g. an injection pipe to be connected.

A third conduit 111 extends from the outer side wall 112 of the valve device 100 into the through-channel 101 and opens into the through-channel 101 in the first through-channel portion 101*a*. The third conduit 111 forms part of a hydraulic control line arranged to control the operation of the valve 200. A connector 111*a* is arranged on the outer side wall 112 in conjunction with the third conduit 111 to allow an external hydraulic control pipe to be connected. Seals 204 and 205 are arranged on the valve 200 on either side of the opening 8 (see also FIG. 2), and the valve 200 is arranged in the spool unit 102 so that the third conduit 111 opens into the through-channel between the seals 204 and 205. Providing hydraulic control fluid into the third conduit 111 thereby allows control of the opening and closing of the valve 200. For example, in the case of chemical injection or gas lift injection, the valve 200 will be brought to its open position by means of the hydraulic control fluid, and the fluid to be injected will be supplied to the second conduit 107.

In an alternative embodiment, the valve 200 is electrically actuated and the third conduit 111 comprises an electric supply line arranged for actuation of the valve 200. A plug may be arranged in the third conduit 111, and the plug may be movable and configured to have a retracted position in which the plug is spaced from the through-channel 101, and an advanced position in which the plug extends into the through-channel 101 and engages a corresponding receiver unit on the electrically actuated valve 200. Electrical actuation thus forms an optional and alternative configuration to the hydraulic actuation shown above.

Figure 4:
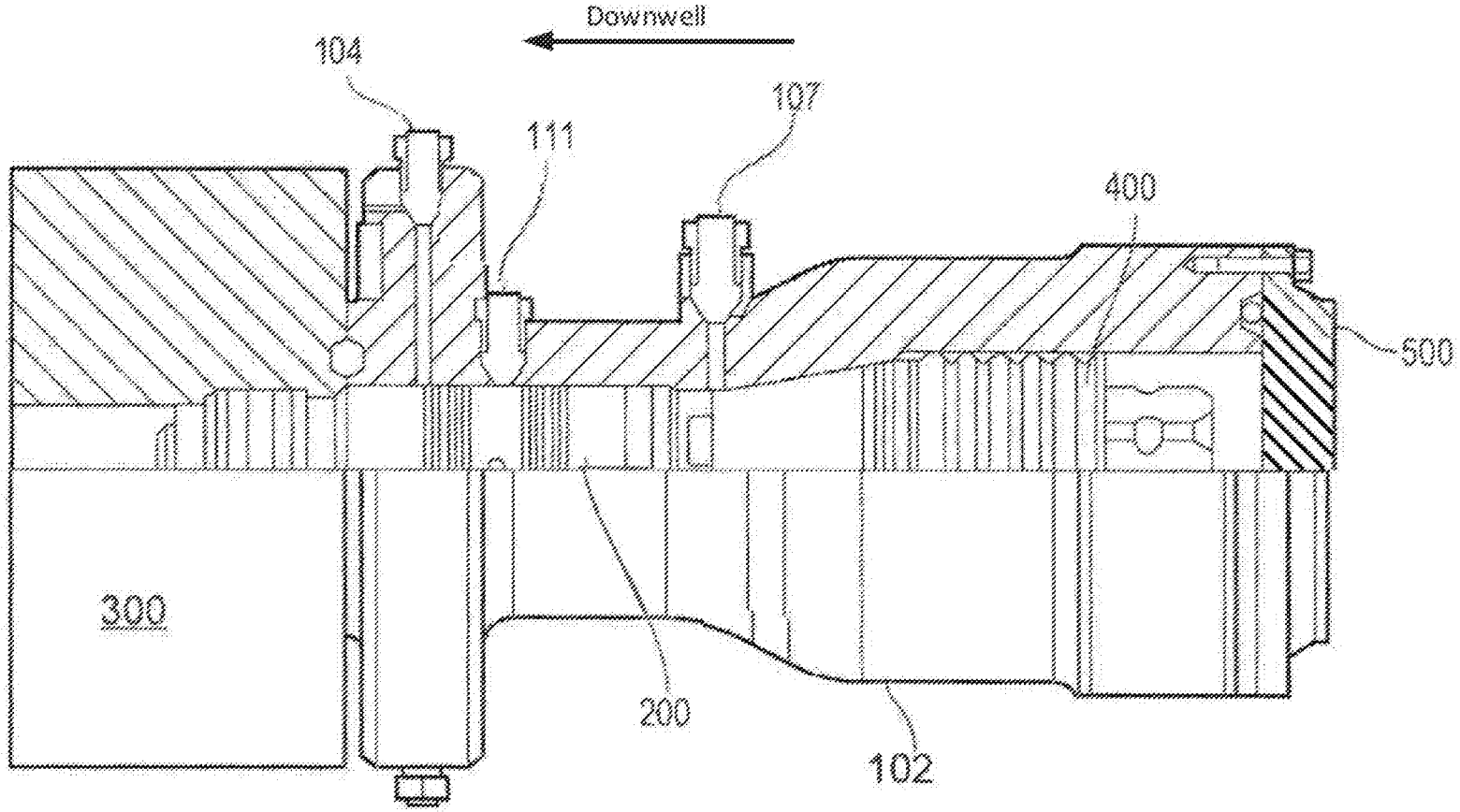
FIG. 4 illustrates a valve device according to an embodiment.

FIG. 4 shows an alternative embodiment in which the spool unit 102 is arranged without the second flange 108.

In one embodiment, a method of operating a valve device will now be described with reference to FIGS. 5-10.

The method can be used for removing or replacing a valve 200 located in a port 301 of a wellhead 300 having a valve device 100 mounted thereon, as also shown in FIG. 3.

Figure 5:
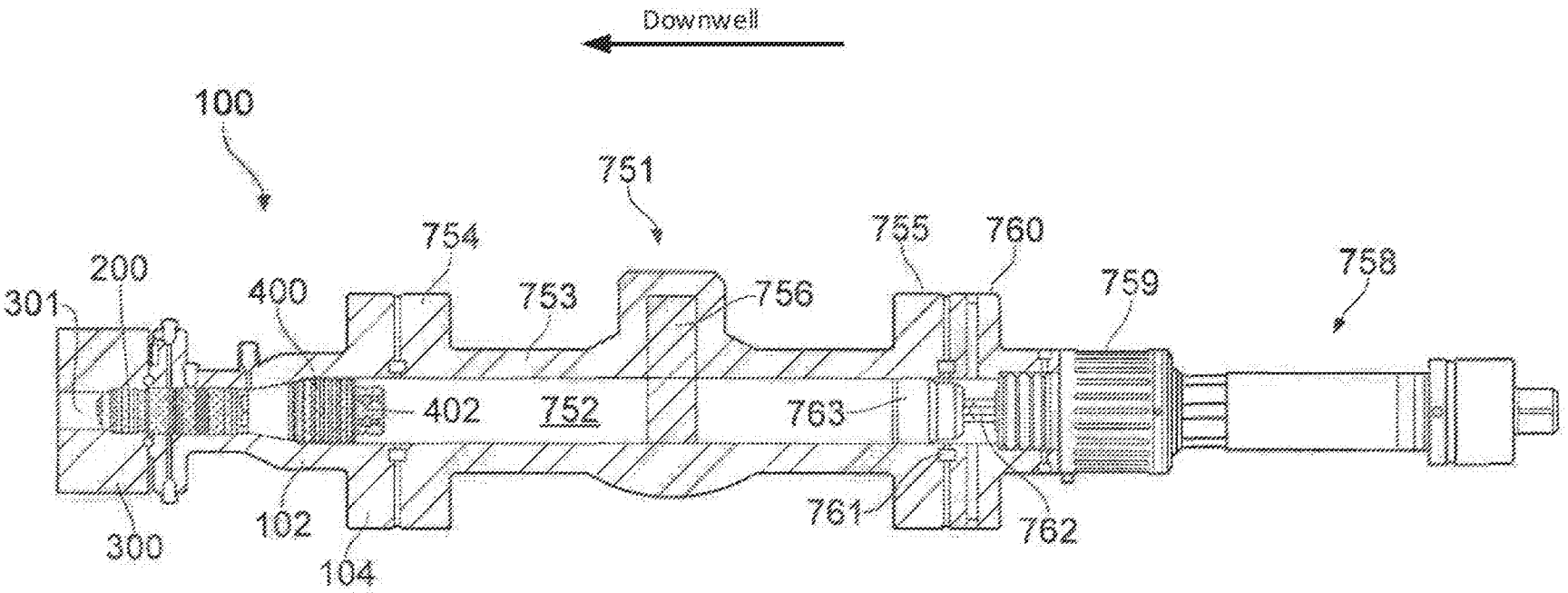
FIGS. 5-10 illustrate steps of a method according to an embodiment.

In a first step, the blind flange 500, if it is mounted when starting to carry out the method, is removed. In the next step, a valve unit 751 is mounted to the second end 102 b, as shown in FIG. 5. The valve unit 751 has a throughbore or channel 752 within an elongated housing 753. At one end, the housing 753 has a first flange 754 and at the other end the housing 753 has a second flange 755. Inside the housing 753, the valve unit 751 has a valve body 756, such as a gate valve, which is operable between a first, closed position in which the valve body 756 blocks the channel 752 providing a fluid-tight seal therein, and a second, open position in which the valve body 756 is retracted such that it does not restrict the channel 752. The channel 752 generally has substantially the same diameter as the opening 105 of the spool unit 102, and the first flange 754 of the valve unit 751 is connected to the second flange 108 of the spool unit 102 such that the through-channel 101 and the channel 752 are arranged coaxially and in sealing relationship.

The next step comprises attaching a placement and removal tool 758 to the valve unit 751, as is also shown in FIG. 5. The tool 758 may, for example, be of the type disclosed in WO 2011/093717. The tool 758 has a housing 759 which has a flange section 760 allowing the tool 758 to be attached to the second flange 755 of the valve unit 751 and aligned with the channel 752. An annular sealing element 761 is positioned between the flanges 755 and 760 to ensure that a fluid-tight connection is formed between the valve 751 and the tool 758. The tool 758 comprises an extendable and rotatable arm 762 which, in the disclosed embodiment, comprises a first, outer arm section 762*a* and a second, inner arm section 762*b* which is telescopically movable within the outer arm section 762*a* (see FIG. 6). At the end of the arm 762, there is attached an interchangeable engagement element 763 which is compatible with one or both of the tool engagement elements 202, 402 of the valve 200 or the plug 400, respectively.

The valve unit 751 and the placement and removal tool 758 can be mounted onto the spool unit 102 sequentially, i.e. first mounting the valve unit 751 to the spool unit 102 and then the tool 758 to the valve unit 751, or these may be pre-connected and mounted onto the spool unit 102 at the same time and in the same operation.

Figure 6:
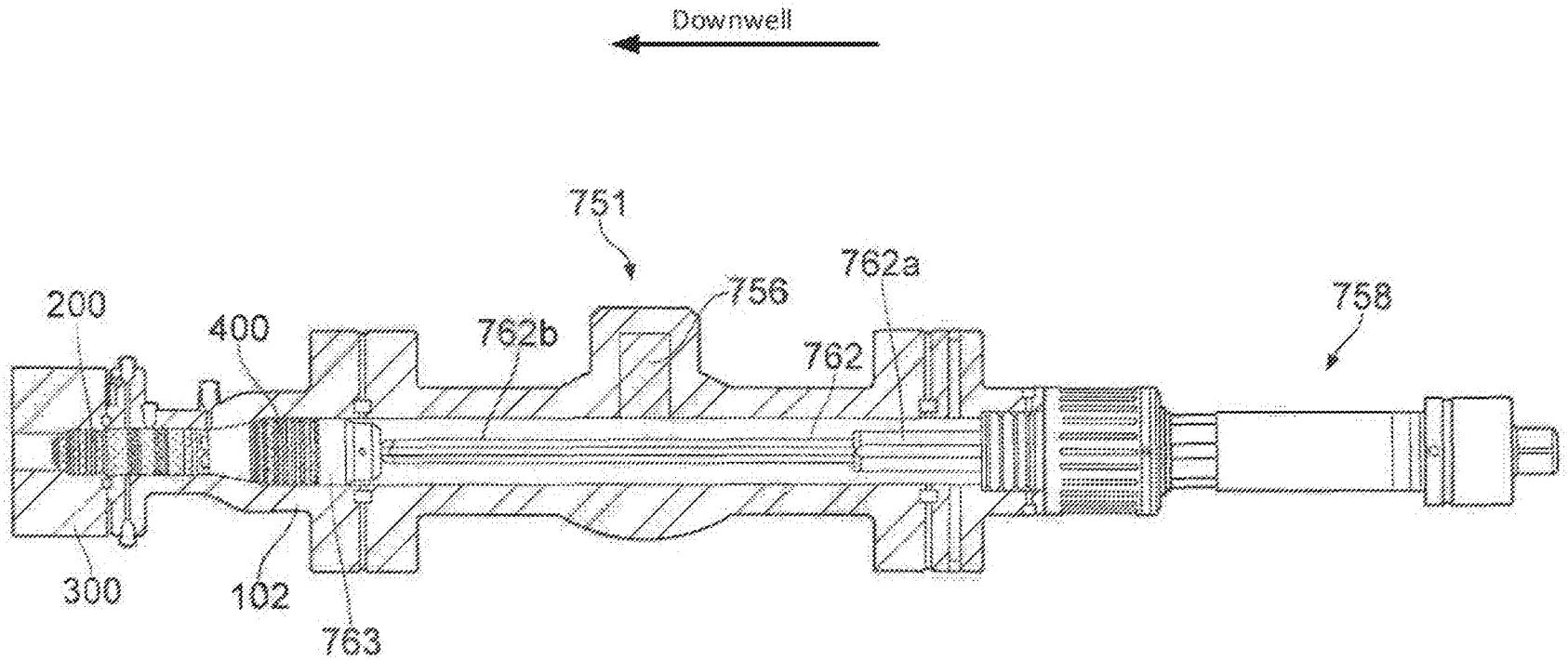

In the next step, the valve body 756, which was originally provided in the closed position, is opened, as shown in FIG. 6. The arm 762 is extended such that the engagement element 763 is brought into contact with and connects to the tool engagement element 402 of the plug 400, as shown in FIG. 6. Thereafter, the arm 462 is brought to rotate such that the threaded engagement between the external threads 401 of the plug 400 and the internal threads 110 of the through-channel 101 is disengaged.

Figure 7:
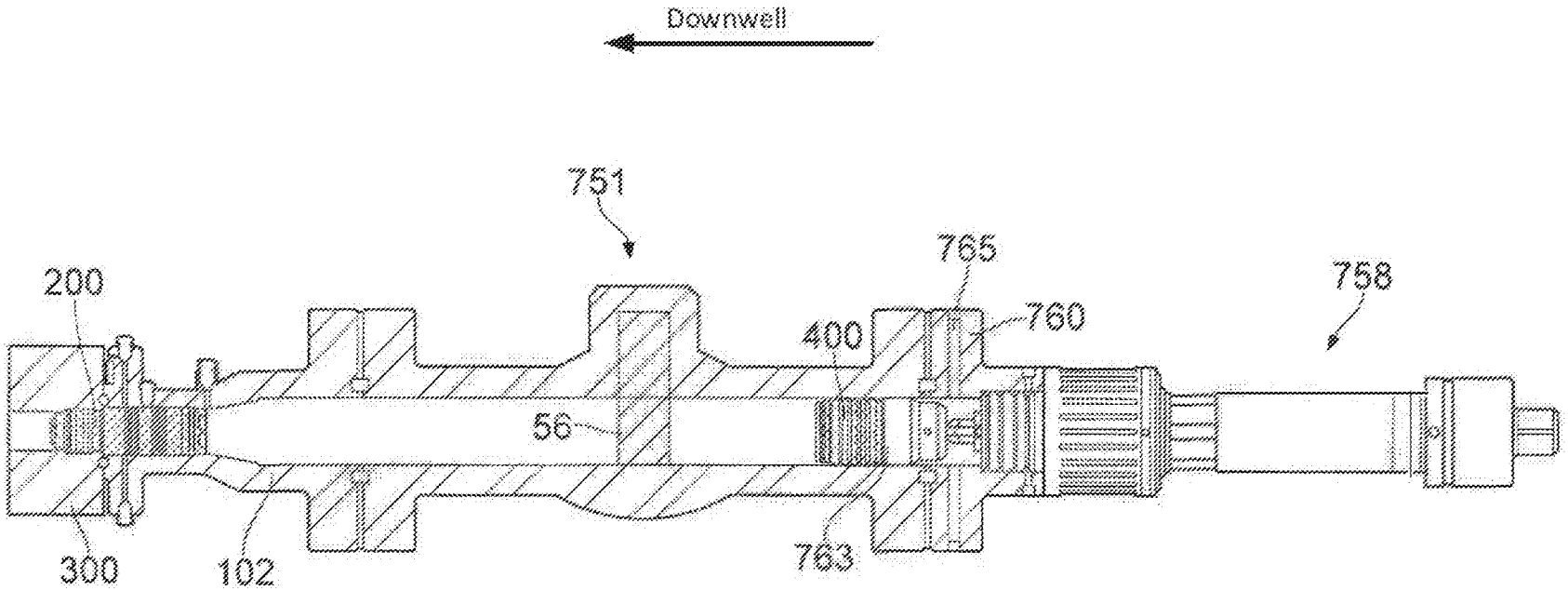

Thereafter, the arm 762 and the plug 400 are retracted out of the spool unit 102 and into the valve unit 751 past the valve body 756, whereafter the valve body 756 is brought to its closed position. This situation is illustrated in FIG. 7.

The next step comprises detaching the tool 758 from the valve unit 751 and removing the plug 400 from the engagement element 763. Prior to detaching the tool 758 from the valve unit 751, the tool 758 may be vented via through-bores or channels 765 in the flange 760 of the tool 758. The engagement element 763 is substituted for a different engagement element 764 (see FIG. 8) which is compatible with the valve 200 and its tool engagement element 202. Alternatively, the same plug engagement element may be used if the tool engagement element 202 of the valve 200 is similar in design to the tool engagement element 402 of the plug 400, and/or if the engagement element 763 is compatible with both tool engagement elements 202 and 402.

Figure 8:
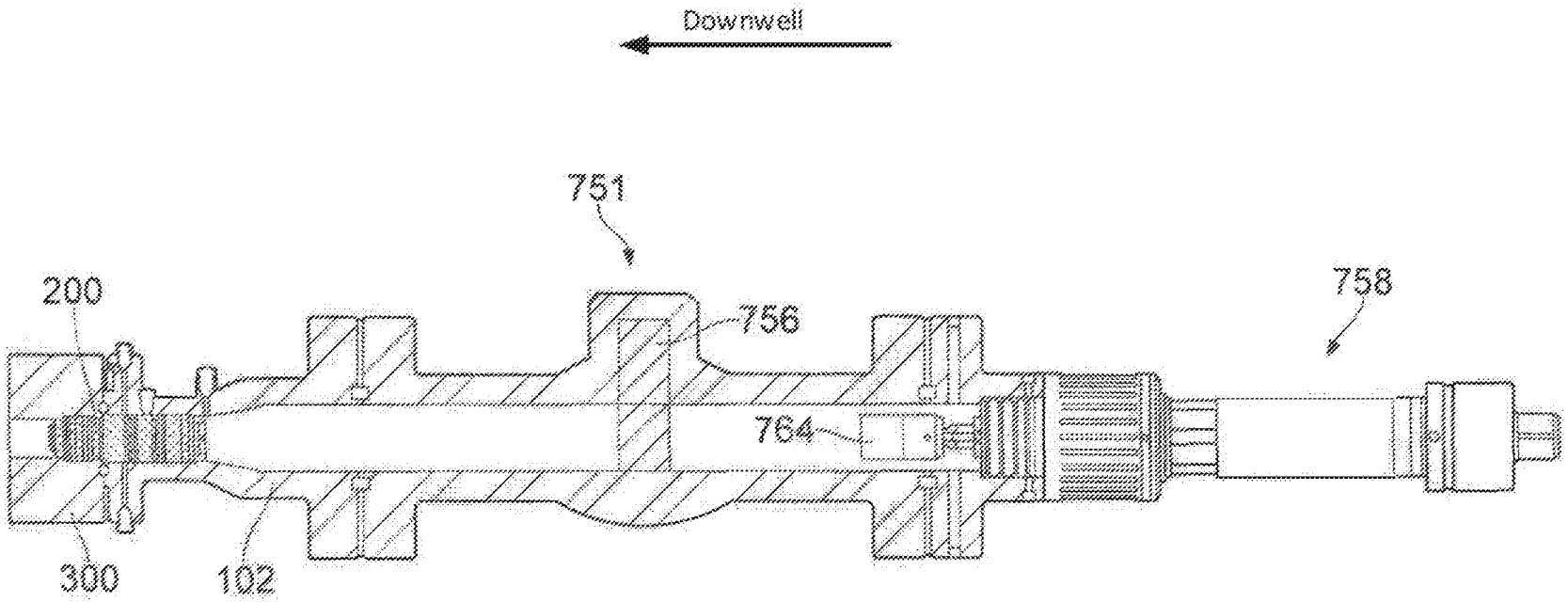
Figure 9:
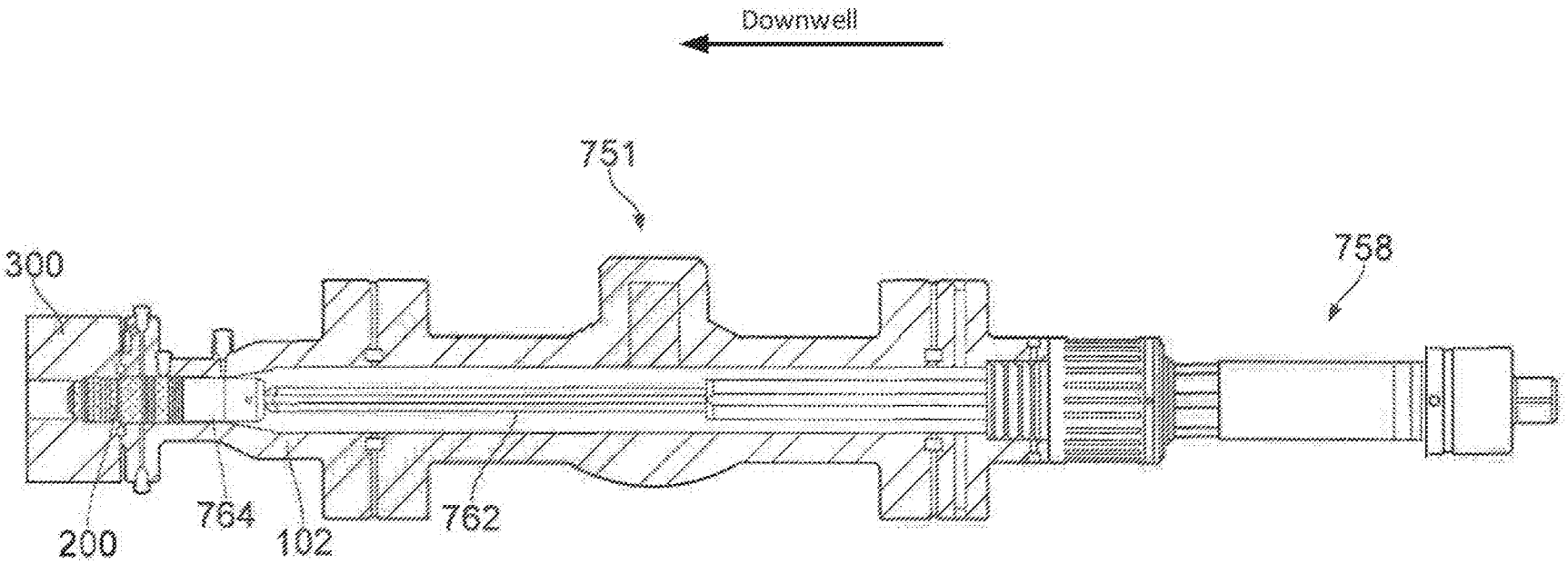

The tool 758 is then reattached to the valve unit 751, as is shown in FIG. 8. Next, the valve unit 751 is once again opened by bringing the valve body 756 to the open position and the arm 762 is extended through the valve unit 751 and into the spool unit 102 such that the engagement element 764 is brought into contact with and connects to the tool engagement element 202 of the valve 200, as shown in FIG. 9. Thereafter, the arm 762 is brought to rotate such that the threaded engagement between the valve 200 and the port 301 is disengaged.

Figure 10:
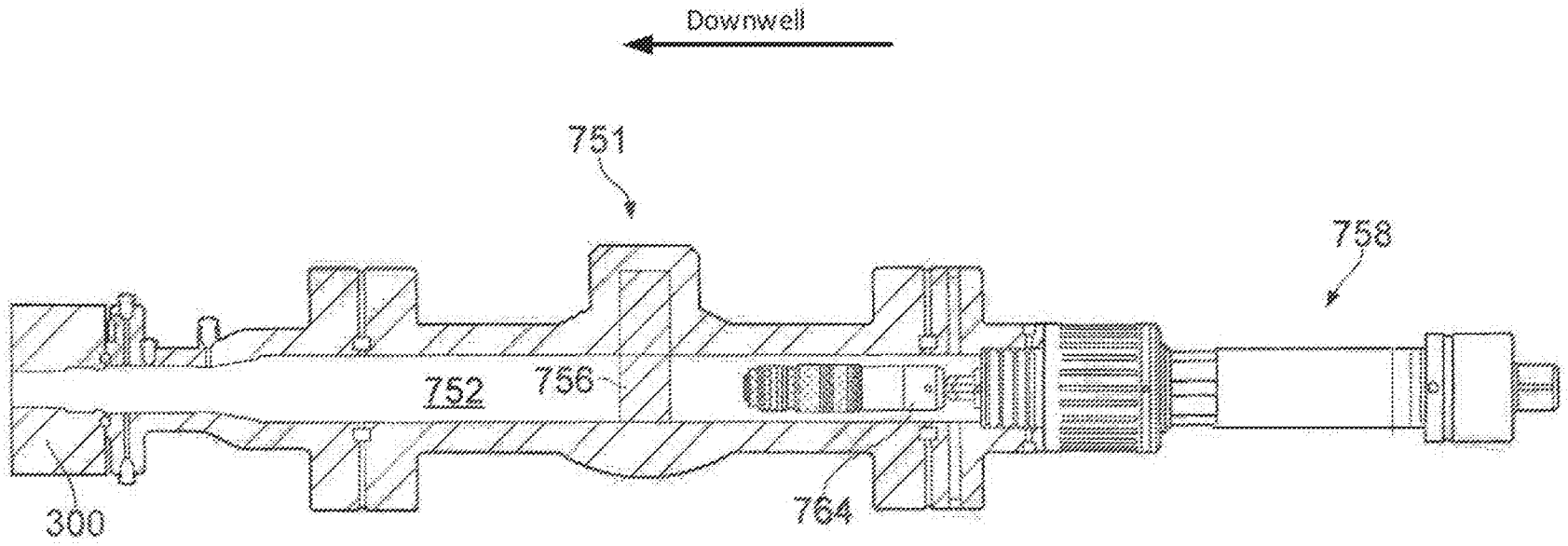

Thereafter, the arm 762 and the valve 200 are retracted out of the spool unit 102 as is shown in FIG. 10, whereafter the valve body 756 is brought to its closed position. Next, the tool 758 is detached from the valve unit 751 and the valve 200 to be removed or replaced is disconnected from the engagement element 764.

The valve 200 has now been removed and can be, for example, serviced or replaced. The valve body 756 is in the closed position, thus holding any pressure from the well reaching the port 301.

In this embodiment, the same tool 758 was used to retrieve both the plug 400 and the valve 200. Alternatively, the tool 758 may be a set of individual tools, with each individual tool having features such as those described in relation to the tool 758, whereby one individual tool can be used for removing the plug 400 and one individual tool for removing the valve 200. In such an embodiment, exchange of the engagement elements 763 and 764 may not be necessary, as different individual tools which are part of tool 758 may be used for removal of the plug 400 and the valve 200 respectively.

To insert the valve 200 (or a replacement valve), the new valve 200 is attached to the engagement element 764 and the tool 758 is reattached to the valve unit 751.

Next, the steps described above are performed substantially in reverse order, i.e.:

the valve body 756 is brought to its open position, the arm 762 is extended through the valve 751 and into the spool unit 102 such that the threads 201 of the new valve 200 are brought into contact with the corresponding threads of the port 301, the arm 762 is brought to rotate such that a fluid-tight, threaded engagement is created between the new valve 200 and the port 301, the arm 762 is retracted out of the spool unit 102 and past the valve body 756, the valve body 756 is brought to its closed position, the tool 758 is detached from the valve unit 751 and the engagement element 764 is substituted for the engagement element 763, the plug 400 is attached to the engagement element 763 and the tool 758 is reattached to the valve unit 751, the valve body 756 is brought to its open position, the arm 762 is inserted through the valve unit 751 and into the spool unit 102 such that the threads 401 of the plug 400 are brought into contact with the threads 110 of the through-channel 101, the arm 762 is brought to rotate such that a fluid-tight, threaded engagement is created between the plug 400 and the through-channel 101, the arm is retracted out of the spool unit 102, the tool 758 is detached from the valve unit 751, the valve unit 751 is detached from the spool unit 102, and the blind flange 500 is reattached to the spool unit 102.

In an embodiment, the valve 200 or new valve 200 may comprise first and second sections 2,3, as illustrated in FIG. 2. In this embodiment, the method may optionally include the steps of retrieving the first section 2 in one operation and the second section 3 in a subsequent, separate operation. This will follow equivalently to that described above, including the steps of inserting the arm 762 into the spool unit 102, operating the arm 762 to disengage the first section 2 from the second section 3, and withdrawing the arm 762 and the first section 2 from the spool unit 102 and past the valve device 756. The first section is then removed from the tool 758, and the equivalent operation is carried out to release the second section 3 from the port 301 and retrieve the second section 3.

In an embodiment, the valve 200 or the new valve 200 may be a dummy valve, i.e. a valve which blocks for fluid flow past the port 301. This may be advantageous if the port 301 is to be permanently or semi-permanently sealed off, for example while obtaining a replacement valve 200 or at times when use of the port 301 is not required for a temporary period or permanently. Alternatively, or additionally, this allows a dummy valve to be removed from the power 301 and an operative valve 200 to be installed by means of the disclosed system and method, for example in a new wellhead completion in which the port 301 had been blocked off by a dummy valve during installation, or a wellhead where the port 301 has been deactivated for a period of time by arranging a dummy valve in the port 301.

According to embodiments of the system and method described herein, a safe and secure valve device for use with wellheads or valve trees is thus provided, while ensuring that the valve 200 can be readily retrieved in case of a need for replacement. A valve device according to embodiments described herein can be made more compact and more robust, and/or less prone to failure.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising embodiments of the disclosure in diverse forms thereof.

The present disclosure is not limited to the embodiments described herein; reference should be had to the appended claims.

The invention is claimed as follows:

1. A method for removing or replacing a valve located in a port of a wellhead having a valve device mounted thereon, the method comprising:

mounting a valve unit and a placement and removal tool to an end of a spool unit of the valve device;

inserting an arm of the placement and removal tool into the spool unit, operating the arm to disengage a plug of the valve device from the spool unit, and withdrawing the arm and the plug out of the spool unit;

detaching the placement and removal tool and the plug from the valve unit;

reattaching the placement and removal tool to the valve unit;

inserting the arm into the spool unit, operating the arm to disengage a valve of the valve device from the port, and withdrawing the arm and the valve out of the spool unit; and detaching the placement and removal tool and the valve from the valve unit.

2. The method according to claim 1, further comprising:

positioning the valve or a replacement valve onto the arm, and reattaching the placement and removal tool to the valve unit;

inserting the arm and the valve or the replacement valve into the spool unit, operating the arm to mount the valve or the replacement valve inside the port, and withdrawing the arm out of the spool unit;

detaching the placement and removal tool from the valve unit, positioning the plug or a new plug onto the arm, and reattaching the placement and removal tool to the valve unit; and inserting the arm and the plug or the new plug into the spool unit, operating the arm to mount the plug or the new plug inside the spool unit.

3. The method according to claim 2, wherein at least one of the steps of operating the arm to mount the valve or the replacement valve inside the port or operating the arm to mount the plug or the new plug inside the spool unit comprises rotating the arm about a longitudinal axis of the placement and removal tool.

4. The method according to claim 1, wherein at least one of the steps of operating the arm to disengage the plug from the spool unit or operating the arm to disengage the valve from the port comprises rotating the arm about a longitudinal axis of the placement and removal tool.

5. The method according to claim 1, further comprising removing a blind flange from the end of the spool unit.

6. The method according to claim 1, further comprising reattaching a blind flange to the end of the spool unit.

7. The method according to claim 1, wherein the valve comprises a first section and a second section connected to each other by threaded parts, wherein the method comprises inserting the arm into the spool unit, operating the arm to disengage the first section from the second section, and withdrawing the arm and the first section out of the spool unit.

8. The method according to claim 1, wherein the valve unit comprises a valve body and a channel, wherein the valve body is configured to move between a closed position and an open position, wherein the valve body blocks the channel when the valve body is in the closed position and the valve body opens the channel when the valve body is in the open position.

9. The method according to claim 8, further comprising moving the valve body to the open position prior to inserting the arm of the placement and removal tool into the spool unit and disengaging the plug of the valve device from the spool unit.

10. The method according to claim 8, wherein the plug is located in a through-channel of the spool unit, and mounting the valve unit to the end of the spool unit comprises connecting a first flange of the valve unit to a flange of the spool unit so that the through-channel of the spool unit is in line with the channel of the valve unit.

11. The method according to claim 10, wherein inserting the arm of the placement and removal tool into the spool unit comprises moving the arm along the channel of the valve unit into the through-channel of the spool unit.

12. The method according to claim 11, prior to detaching the placement and removal tool and the plug from the valve unit, venting the placement and removal tool through a channel in the flange of the placement and removal tool.

13. A method for arranging a valve in a port of a wellhead having a valve device mounted thereon, the method comprising:

mounting a valve unit and a placement and removal tool to an end of a spool unit of the valve device;

positioning a valve onto an arm of the placement and removal tool;

inserting the arm and the valve into the spool unit;

operating the arm to mount the valve inside the port, and withdrawing the arm out of the spool unit;

detaching the placement and removal tool from the valve unit;

positioning a plug onto the arm, and reattaching the placement and removal tool to the valve unit;

inserting the arm and the plug into the spool unit; and operating the arm to mount the plug inside the spool unit.

14. The method according to claim 13, wherein the valve comprises a first section and a second section connected to each other by threaded parts, wherein the method comprises inserting the arm into the spool unit, operating the arm to mount the first section onto the second section, and withdrawing the arm out of the spool unit.

15. The method according to claim 13, wherein at least one of operating the arm to mount the valve inside the port or operating the arm to mount the plug inside the spool unit comprises rotating the arm about a longitudinal axis of the placement and removal tool.

16. The method according to claim 13, further comprising attaching a blind flange to the end of the spool unit.

17. The method according to claim 13, wherein the valve unit comprises a valve body and a channel, wherein the valve body is configured to move between a closed position and an open position, wherein the valve body blocks the channel when the valve body is in the closed position and the valve body opens the channel when the valve body is in the open position.

18. The method according to claim 17, further comprising moving the valve body to the open position prior to inserting the arm of the placement and removal tool and the valve into the spool unit.

19. The method according to claim 13, prior to detaching the placement and removal tool from the valve unit, venting the placement and removal tool through a channel in a flange of the placement and removal tool.

20. The method according to claim 13, wherein the valve is a dummy valve.

* * * * *